US006812896B2

(12) United States Patent
Wallace et al.

(10) Patent No.: US 6,812,896 B2
(45) Date of Patent: Nov. 2, 2004

(54) SELECTIVELY COUPLED TWO-PIECE ANTENNA

(75) Inventors: Raymond C. Wallace, San Diego, CA (US); Allen M-T. Tran, San Diego, CA (US); John K. M. Lee, Ramona, CA (US); Ernest T. Ozaki, Poway, CA (US)

(73) Assignee: Qualcomm Incorporated, San Diego, CA (US)

( * ) Notice: Subject to any disclaimer, the term of this patent is extended or adjusted under 35 U.S.C. 154(b) by 16 days.

(21) Appl. No.: 10/228,698

(22) Filed: Aug. 26, 2002

(65) Prior Publication Data

US 2003/0067412 A1 Apr. 10, 2003

Related U.S. Application Data

(60) Provisional application No. 60/315,289, filed on Aug. 27, 2001.

(51) Int. Cl.[7] ..... H01Q 1/24

(52) U.S. Cl. ..... 343/702; 343/889; 343/895; 343/901

(58) Field of Search ..... 343/702, 749, 343/752, 889, 895, 893, 900, 901, 905, 906

(56) References Cited

U.S. PATENT DOCUMENTS 6,005,523 A 12/1999 Rudisill ..... 343/702
6,008,765 A * 12/1999 Davidson et al. ..... 343/702
6,018,321 A * 1/2000 Simmons et al. ..... 343/702
6,239,755 B1 5/2001 Klemens et al. ..... 343/702

FOREIGN PATENT DOCUMENTS

GB 2275369 8/1994 ..... H01Q/1/08

* cited by examiner

*Primary Examiner*—Shih-Chao Chen
(74) *Attorney, Agent, or Firm*—Philip Wadsworth; Charles Brown; Richard Bachand

(57) ABSTRACT

A selectively coupled two-piece antenna for use in a mobile phone having a casing and radio frequency (RF) communications circuitry includes a composite radiator that is selectively extendable from and retractable into the casing and a communications interface that is connected to the RF communications circuitry. The composite radiator has first and second radiating elements, and a connecting element. When the composite radiator is extended, the connecting element connects the first and second radiating elements. In this position, the communications interface connects the RF communications circuitry to the first and second radiating elements. Thus, the RF communications circuitry transmits and/or receives RF signals through both the first and second radiating elements as a top loaded antenna. However, when the composite radiator is retracted, the connecting element electrically isolates the first and second radiating elements.

5 Claims, 7 Drawing Sheets

SELECTIVELY COUPLED TWO-PIECE ANTENNA

RELATED APPLICATIONS

This applications claims priority to U.S. Provisional Application No. 60/315,289 filed on Aug. 27, 2001.

CROSS-REFERENCE TO RELATED APPLICATIONS

The following application of common assignee contain some common disclosure with that of the present invention: Balanced, Retractable, Mobile Phone Antenna, application Ser. No. 09/429,768, filed Oct. 28, 1999, the disclosure of which is incorporated by reference herein in its entirety.

BACKGROUND OF THE INVENTION

1. Field of the Invention

The present invention relates generally to antennas. More specifically, the present invention relates to a selectively coupled two-piece antenna for mobile phones.

2. Description of the Related Art

Personal communications devices such as mobile phones have become increasingly common in the past few years. Whip antennas are commonly used in mobile telephones. A shortcoming of whip antennas is that they often catch on things and become damaged. In order to prevent such damage, many whip antennas are designed to be retractable into the mobile telephone casing. Thus, the typical mobile phone, whether it be for use in a cellular system or a satellite telephone system, has a whip antenna that is retractable into the casing when not in use. A user desiring to send or receive a call will extend the antenna from the casing. Similarly, when a user is not engaged in a call, the antenna can be retracted into the casing.

For many mobile phones, the center of its antenna is aligned with a user's head and/or hands during operation. Due to the standing wave patterns in a typical whip antenna, the user's head and/or hands tends to obstruct signals that are transmitted and received through the whip antenna. This obstruction is also known as shadowing and tends to degrade mobile phone performance.

As technology advances, the size of mobile phones is continually reduced. As a consequence of this reduction in size, small sized mobile phones contain less space to accommodate whip antennas. Thus, retractable whip antennas that are used with such small sized mobile phones have also by necessity become shorter. Unfortunately, shorter whip antennas are less able to avoid the signal shadowing effects described above.

Some mobile phones employ a helical antenna instead of a whip. For these antennas, a helix protrudes slightly from the phone casing and is usually fixed. Therefore, it is neither retractable nor extendable. User convenience is a motivation behind the use of fixed helical antennas. If a user does not have to extend and retract the antenna, operation becomes simpler from the user's perspective. Also, a phone employing a fixed helical antenna can be made somewhat more compact since the phone's casing does not have to accommodate the length of a retracted whip. However, the shadowing problem describe above is often exacerbated with a helix.

Many phones today use a combination of a helical antenna and a whip antenna. One such approach involves a configuration where a helix is disposed on the exterior of the casing and an extendable whip passes through the center axis of the helix.

Another approach involves placing a helix on the distal end of the whip. When the whip is retracted, only the helix protrudes from the casing. In a first variation of this approach, the whip and helix are electrically disconnected in both the extended and retracted positions. In a second variation of this approach, the whip and helix are electrically connected in the extended position, but electrically disconnected in the retracted position.

Examples of such known devices are described in the following U.S. patents:

U.S. Pat. No. 5,426,440 to Shimada et al.,

U.S. Pat. No. 5,594,457 to Wingo,

U.S. Pat. No. 5,650,789 to Elliot et al., and

U.S. Pat. No. 5,717,408 to Sullivan et al.

Many mobile phones employ digital circuitry that generates signals having high frequency harmonics. In certain cases, these harmonics can fall within a mobile phone's receive band. When an antenna is retracted, it is often in close proximity to such digital circuitry. As a result of this proximity, the portion of the antenna that is in the mobile phone's casing can receive these signals and send them to components within the mobile phone designated for the reception of communications signals. This phenomena is known as self-jamming, and it intensifies as mobile phones become smaller in size. Self-jamming causes interference with radio frequency (RF) communications and degrades mobile phone performance.

Self-jamming can be mitigated by shielding the electronic components that generate high frequency harmonics in a grounded conductive can. Alternatively, self-jamming can be mitigated by shielding the retracted portion of the antenna with a conductive tube that is grounded. However, these solutions are costly and involve several mechanical and spatial constraints. Another approach involves grounding the antenna when it is in its retracted position. This grounding creates a high input impedance for the antenna and requires the implementation of matching circuitry to match the antenna impedance to the impedance of other RF components. This matching circuitry consumes space in the mobile phone and increases the phone's cost.

As a result, it has been recognized that there is a need for a mobile phone antenna that reduces shadowing caused by users when extended and provides a compact, cost effective approach to the mitigation of self-jamming when retracted.

BRIEF SUMMARY OF THE INVENTION

The present invention is directed to a selectively coupled two-piece antenna for use in a mobile phone that has a casing and RF communications circuitry. The selectively coupled two-piece antenna comprises a composite radiator that is selectively extendable from and retractable into the casing and a communications interface that is connected to the RF communications circuitry. The composite radiator has first and second radiating elements, and a connecting element.

When the composite radiator is extended, the connecting element connects the first and second radiating elements. In this position, the communications interface connects the RF communications circuitry to the first and second radiating elements. Thus, the RF communications circuitry transmits and/or receives RF signals through both the first and second radiating elements as a top loaded antenna.

However, when the composite radiator is retracted, the connecting element electrically isolates the first and second radiating elements. In this position, the composite radiator contacts the communications interface so that the first radiating element is electrically connected to the RF communications circuitry. Thus, in this position, the second radiating element is electrically disconnected from the RF communications circuitry. Therefore, the RF communications circuitry exchanges signals with only the first radiating element when the composite radiator is retracted.

Another advantage of the present invention is the elimination of self-jamming interference when the composite radiator is retracted.

Further features and advantages of the invention, as well as the structure and operation of various embodiments of the invention, are described in detail below with reference to the accompanying drawings.

BRIEF DESCRIPTION OF THE DRAWINGS/ FIGURES

The present invention will be described with reference to the accompanying drawings. In the drawings, like reference numbers generally indicate identical, functionally similar, and/or structurally similar elements. The drawing in which an element first appears is indicated by the leftmost digit(s) in the reference number.

DETAILED DESCRIPTION OF THE INVENTION

I. Overview of the Present Invention

Figure 1B:
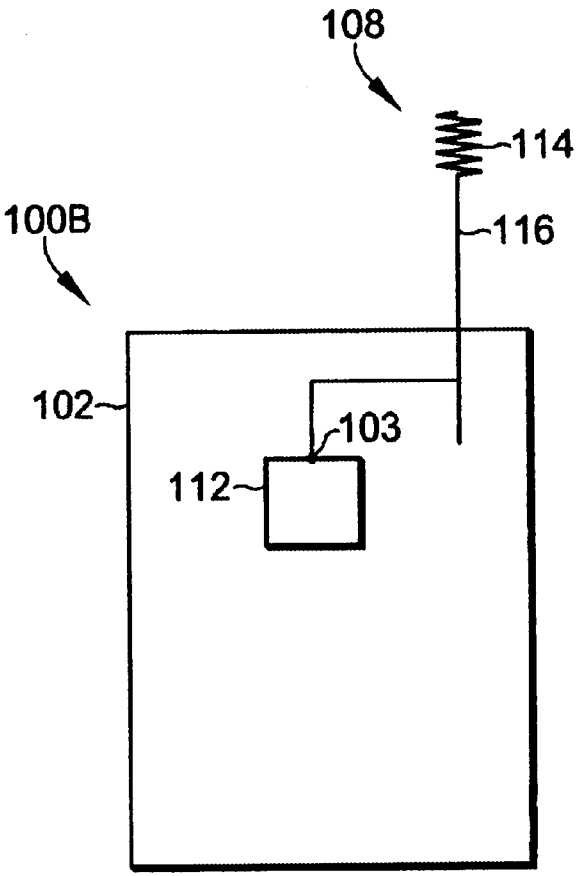
FIG. 1B illustrates an exemplary mobile phone employing a top loaded antenna.
Figure 1A:
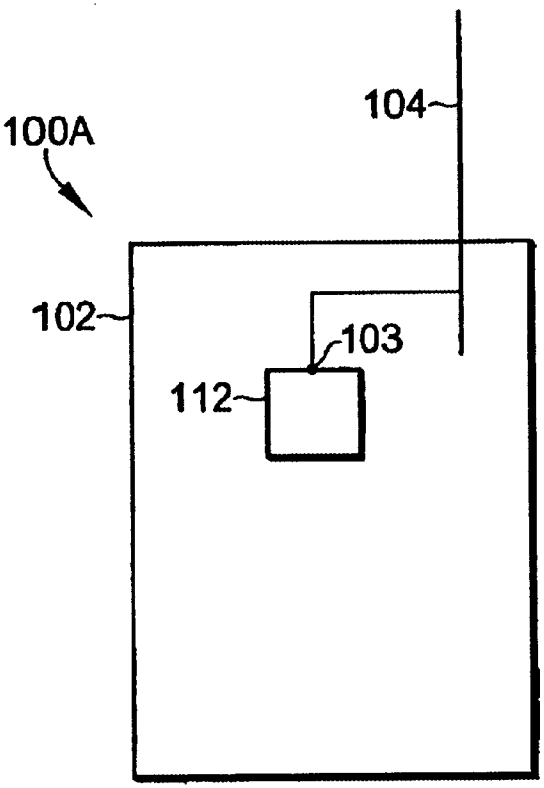
FIG. 1A illustrates an exemplary mobile phone employing a whip antenna.

FIGS. 1A and 1B are block diagrams of an exemplary mobile phone 100 employing different types of antennas. Schematically shown mobile phone 100 comprises a casing 102 that houses RF communications circuitry 112. In addition, mobile phone 100 comprises an antenna that is connected to RF communications circuitry 112. RF communications circuitry 112 sends and receives RF signals through this antenna. FIG. 1A shows mobile phone 100 having a whip antenna 104.

FIG. 1B shows mobile phone 100 having a top loaded antenna 108. Top loaded antenna 108 comprises two radiating elements. As illustrated in FIG. 1B, top loaded antenna 108 comprises a helix 114 connected to a whip 116. However, other shaped radiating elements may be employed, as would be apparent to a person skilled in the relevant arts.

Whip or top loaded mobile phone antennas are typically retractable. Often, when the antenna is retracted into a mobile phone casing, it is still active. The retracted antenna will continue to receive RF signals and send them to RF communications circuitry 112. Mobile phone 100 includes electronic components (not shown) that generate signals having high frequency harmonics. These harmonics can fall into the receive band of the mobile phone. When an antenna is retracted, it is often in close proximity to these electronic components. Because of this close proximity, the retracted antenna will receive these harmonics and send them to RF communications circuitry 112. This phenomena is known as self-jamming. Self-jamming causes interference with RF communications and degrades the performance of mobile phone 100.

As described above, self-jamming can be mitigated by shielding the electronic components that generate high frequency harmonics in a grounded conductive can. Alternatively, self-jamming can be mitigated by shielding the retracted portion of the antenna with a conductive tube that is grounded. However, these solutions are costly and involve several mechanical and spatial constraints. Another approach involves grounding the antenna when it is in its retracted position. This grounding creates a high input impedance for the antenna and requires the implementation of matching circuitry to match the antenna impedance to the impedance of other RF components. This matching circuitry consumes space in the mobile phone and increases the phone's cost.

II. The Invention

The present invention provides an antenna that is configured as a top loaded antenna when extended and a helix when retracted. In a preferred embodiment, the extended top loaded antenna comprises a quarter-wave whip (also known as a monopole) connected to a half-wave helix.

Figure 2B:
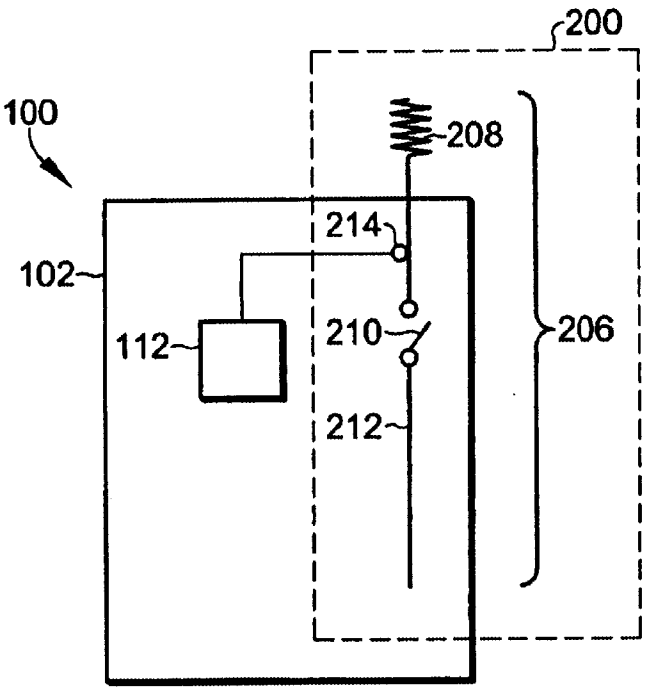
FIG. 2B is a block diagram of a selectively coupled two-piece antenna in a retracted state.
Figure 2A:
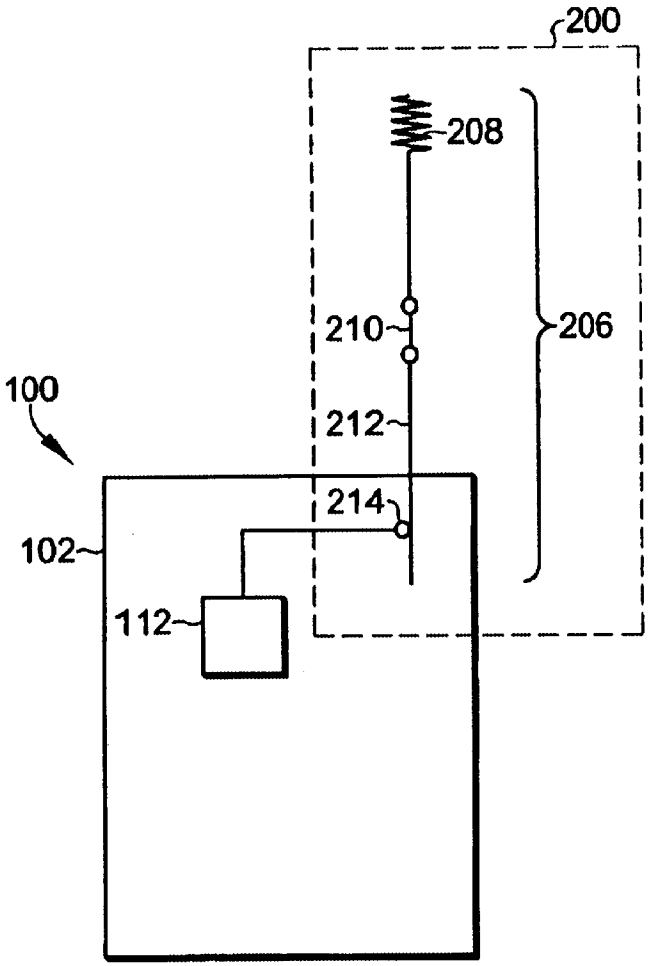
FIG. 2A is a block diagram of a selectively coupled two-piece antenna in an extended state.

FIGS. 2A and 2B are block diagrams of a selectively coupled two-piece antenna 200 according to a preferred embodiment. Antenna 200 comprises a composite radiator 206 and a communications interface 214. Communications interface 214 is attached to, and housed inside, casing 102 of mobile phone 100. Communications interface 214 is connected to RF communications circuitry 112. Communications interface 214 electrically connects with portions of composite radiator 206, thereby establishing an electrical connection between RF communications circuitry 112 and antenna 200. The electrical connection of interface 214 and radiator 206 may be a direct (galvanic) connection or an indirect (e.g., capacitive or inductive) connection. Composite radiator 206 is selectively extendable from and retractable into casing 102. Composite radiator 206 comprises a first radiating element 208, a connecting element 210, and a second radiating element 212. First radiating element 208 is preferably a half-wave helix, while second radiating element 212 is preferably a quarter-wave whip (also known as a monopole). However, other antenna types may be used, as would become apparent to a person skilled in the relevant art. For example, any type of antenna elements in which the first element distributes the standing current/voltage wave over a longer distance than the second element could be used. Connecting element 210 functions as a switch between first and second radiating elements 208 and 212. Based on whether composite radiator 206 is extended or retracted, connecting element 210 electrically connects and disconnects radiating elements 208 and 212.

FIG. 2A illustrates selectively coupled two-piece antenna 200 in an extended position. In this position, connecting element 210 electrically connects first radiating element 208 and second radiating element 212. In addition, composite radiator 206 electrically connects with communications interface 214 at second radiating element 212. When first radiating element 208 and second radiating element 212 are electrically connected, RF communications circuitry 112 transmits and/or receives RF signals through both radiating elements 208 and 212. Therefore, when extended, composite radiator 206 performs as a top loaded antenna.

FIG. 2B illustrates antenna 200 in a retracted position. In this position, composite radiator 206 electrically connects with communications interface 214 so that radiating element 208 is electrically connected to RF communications circuitry 112. Furthermore, when composite radiator 206 is retracted, radiator 212 lies wholly inside casing 102. As described above, when a radiating element is retracted into casing 102, self-jamming problems can occur. To mitigate these problems, connecting element 210 electrically disconnects radiating element 208 and radiating element 212. This disconnection prevents second radiating element 212 from passing RF energy to RF communications circuitry 112. Therefore, when composite radiator 206 is retracted, RF communications circuitry 112 transmits and/or receives RF signals only through radiating element 208.

Connecting element 210 can be implemented as a electronic switch, as would be apparent to persons skilled in the relevant art(s). Also, connecting element 210 can be implemented through mechanical techniques, such as the techniques described below with reference to FIGS. 3A–4B.

Figure 3A:
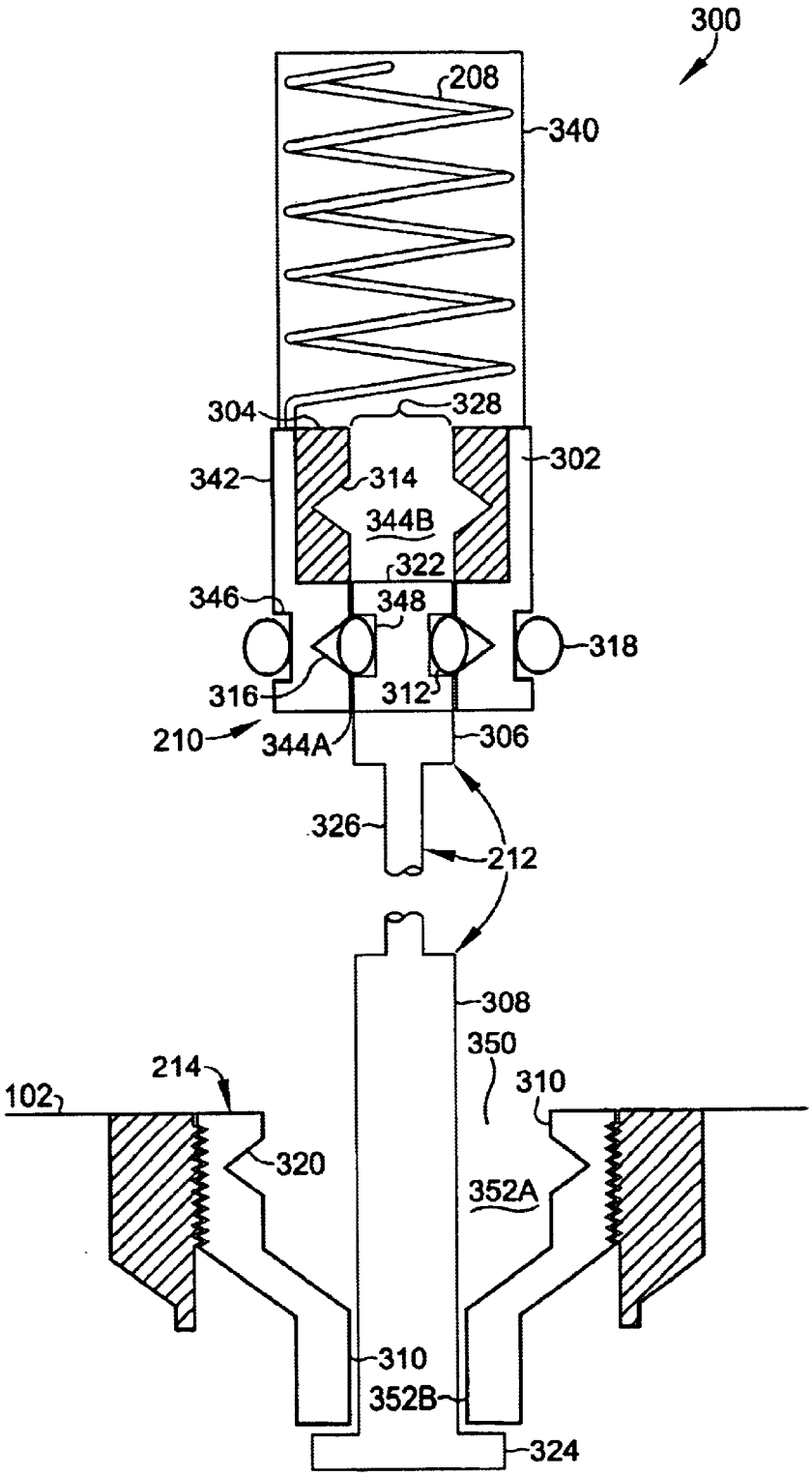
FIG. 3A is a cross-sectional view of a first implementation of a selectively coupled two-piece antenna in an extended state.
Figure 3B:
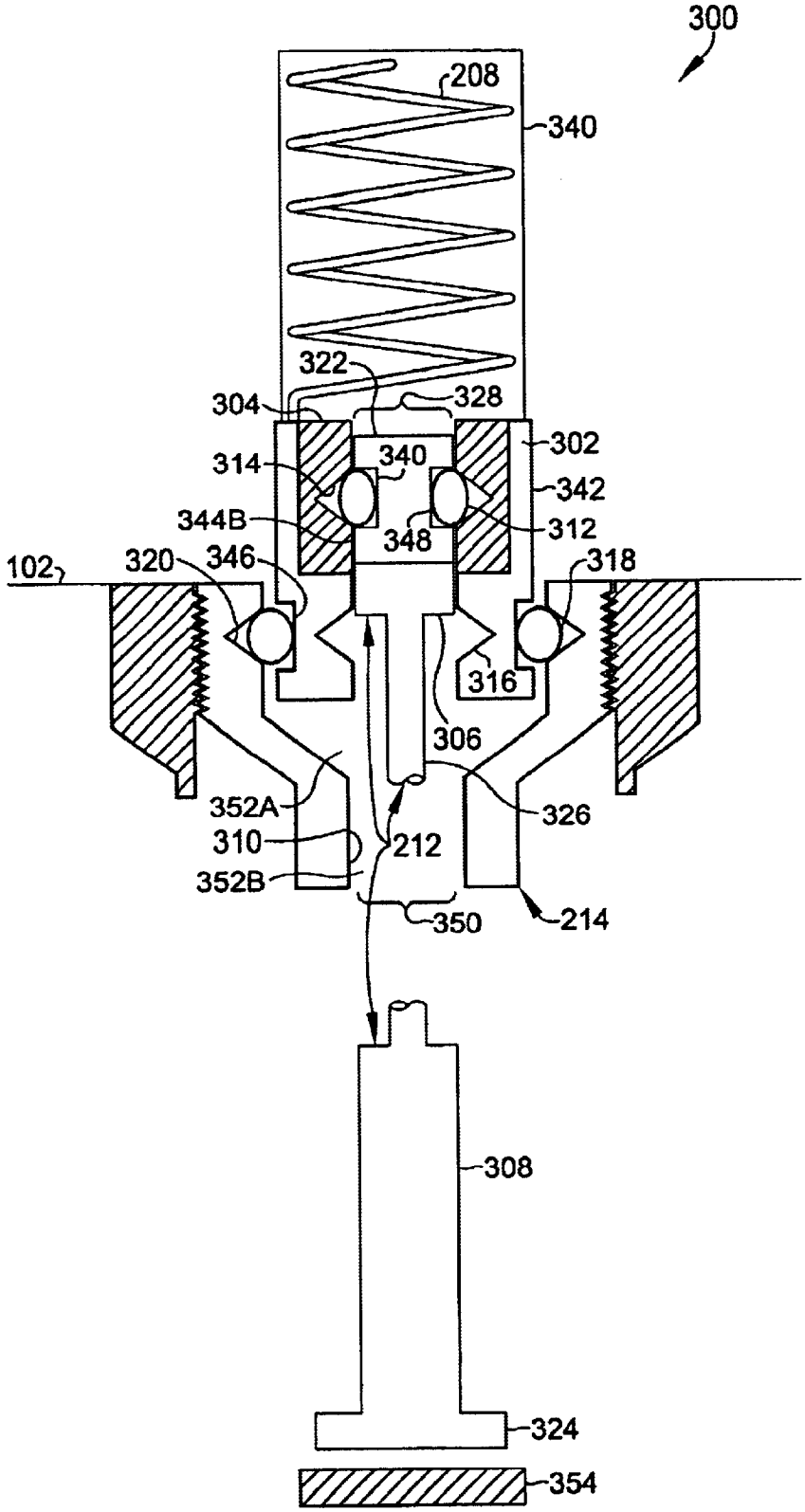
FIG. 3B is a cross-sectional view of a first implementation of a selectively coupled two-piece antenna in a retracted state.

FIGS. 3A and 3B are cross-sectional views of a first implementation 300 of antenna 200. FIG. 3A shows antenna 200 in an extended position. FIG. 3B shows antenna 200 in a retracted position. As described above, antenna 200 comprises composite radiator 206 and communications interface 214. Composite radiator 206 comprises first radiating element 208, connecting element 210, and second radiating element 212.

Radiating element 208 is electrically conductive. In a preferred embodiment, radiating element 208 is a helix formed of copper wire. However, in alternate embodiments, radiating element 208 may be implemented in other shapes and with other materials that are suitable for RF communications. In addition, radiating element 208 is preferably covered with a protective plastic cap 340. Radiating element 208 is attached to connecting element 210 by any suitable attachment means, such as glue, epoxy, press fitting, etc.

Connecting element 210 comprises a conductor portion 302 and an insulator portion 304. Conductor portion 302 is formed of any conductive material suitable for RF communications. Insulator portion 304 is attached to conductor portion 302 and is formed of an electrically insulating dielectric material such as plastic. Conductor portion 302 is electrically connected to radiating element 208. Conductor portion 302 includes an outer surface 342 that establishes an electrical connection with communications interface 214 when radiator 206 is retracted.

Connecting element 210 defines a connecting aperture 328. Connecting aperture 328 comprises a conducting segment 344*a* and an insulating segment 344*b*. Conducting segment 344*a* is defined by conductor portion 302 and insulating segment 344*b* is defined by insulating portion 304. When composite radiator 206 is extended, conducting segment 344*a* coaxially surrounds and contacts a first contact portion 306 of second radiating element 212, thereby electrically connecting radiating elements 208 and 212. However, when composite radiator 206 is retracted, insulating segment 344*b* coaxially surrounds and contacts first contact portion 306, thereby electrically isolating radiating elements 208 and 212 from each other.

Connecting element 210 further comprises a connection detent 316 and an isolation detent 314. Connection detent 316 and isolation detent 314 function to retain radiating element 212 in fixed positions with respect to connecting element 210. These positions depend on whether composite radiator 206 is extended or retracted.

Connection detent 316 is a recess formed on conductor portion 302. In particular, connection detent 316 is formed in conducting segment 344*a* of connecting aperture 328. When composite radiator 206 is extended, as shown in FIG. 3A, connection detent 316 engages with a locking mechanism 312 that is attached to radiating element 212. The engagement of locking mechanism 312 by connection detent 316 establishes contact between second radiating element 212 and conductor portion 302. This contact electrically connects radiating elements 208 and 212.

Isolation detent 314 is a recess formed on insulator portion 304. In particular, isolation detent 314 is formed in insulating segment 344*b* of connecting aperture 328. When composite radiator 206 is retracted, isolation detent 314 engages with locking mechanism 312. The engagement of locking mechanism 312 by isolation detent 314 electrically isolates radiating elements 208 and 212.

Locking mechanism 312 is a deformable, resilient tubular, structure formed of an electrically conductive material. Examples of such materials include Beryllium Copper (BeCu) and rubber loaded with conductive particles such as carbon and/or silver. Locking mechanism 312 coaxially surrounds and attaches to first contact portion 306 at a locking mechanism fitting 348. In an alternate embodiment, locking mechanism 312 comprises one or more resilient "c-shaped" rings formed of BeCu, or any other conductive material that is resilient. These rings are distributed around the circumference of first contact portion 306 at locking mechanism fitting 348. During engagement with either connection detent 316 or isolation detent 314, locking mechanism 312 expands against the corresponding detent to retain second radiating element 212 in its alignment with connecting element 210. Once locking mechanism 312 expands into one of these detents, the application of an extending or retracting force on radiating element 208 is required to change this alignment.

Locking mechanism fitting 348 is formed around the circumference of first contact portion 306. Locking mechanism fitting 348 is configured for the attachment of locking mechanism 312. Locking mechanism fitting 348 is a channel formed on a surface of first contact portion 306. Locking mechanism 312 is attached to first contact portion 306 at locking mechanism fitting 348. Locking mechanism 312 can be attached to first contact portion 306 by any attachment techniques known to persons skilled in the relevant arts. Such techniques include soldering, welding, and adhesive mounting. Locking mechanism 312 may also be attached to first contact portion 306 through a captivating elastic force imparted by locking mechanism 312 onto locking mechanism fitting 348, as would be apparent to a person skilled in the relevant art.

Connecting element 210 further comprises a mounting mechanism 318 and a mounting mechanism fitting 346. Mounting mechanism fitting 346 is configured for the attachment of mounting mechanism 318. Mounting mechanism fitting 346 is formed on conductor portion 302 of connecting element 210. More specifically, mounting mechanism fitting 346 is formed on outer surface 342 of connecting element 210. Mounting mechanism fitting 346 is a channel formed on outer surface 342 of connecting element 210. Mounting mechanism 318 is attached to connecting element 210 at mounting mechanism fitting 346.

Mounting mechanism 318 is a deformable, resilient tubular structure formed of an electrically conductive material. Examples of such materials include Beryllium Copper (BeCu) and rubber loaded with conductive particles such as carbon and/or silver. Mounting mechanism 318 coaxially surrounds and contacts connecting element 210 at mounting mechanism fitting 346. In an alternate embodiment, mounting mechanism 318 comprises one or more resilient "c-shaped" rings formed of BeCu, or any other conductive material that is resilient. These rings are distributed around the circumference of connecting element 210 at mounting mechanism fitting 346. Mounting mechanism 318 can be attached to connecting element 210 by any attachment techniques known to persons skilled in the relevant arts. Such techniques include soldering, welding, and adhesive mounting. Mounting mechanism 318 may also be attached to connecting element 210 through a captivating elastic force imparted by mounting mechanism 318 onto mounting mechanism fitting 346, as would be apparent to a person of ordinary skill in the art.

In the retracted position shown in FIG. 3B, mounting mechanism 318 engages with a mounting detent 320 formed on communications interface 214. Mounting mechanism 318 engages with mounting detent 320 by expanding against it. Once mounting mechanism 318 engages with mounting detent 320, the application of an extending force is required to disengage mounting mechanism 318 from mounting detent 320.

Radiating element 212 comprises a first end 322, a second end 324, first contact portion 306, a second contact portion 308, locking mechanism 312, and a whip portion 326. In a preferred embodiment, radiating element 212 is composed of Nickel Titanium (NiTi). NiTi has a high memory factor. Thus, radiating element 212 can be bent and returned to its original shape. In alternate embodiments, radiating element 212 may be implemented in other shapes and with other materials that are suitable for RF communications.

First and second ends 322 and 324 are opposite each other. First contact portion 306 is located towards first end 322, while second contact portion 308 is located towards second end 324. Contact portions 306 and 308 are electrically connected by whip portion 326.

As described above, first contact portion 306 is coaxially surrounded by either conducting segment 344a or insulating segment 344b of connecting aperture 328. When composite radiator 206 is extended, as illustrated in FIG. 3A, first contact portion 306 is coaxially surrounded by conducting segment 344*a*. However, when composite radiator 206 is retracted, as illustrated in FIG. 3B, first contact portion 306 is coaxially surrounded by insulating segment 344*b*. In a preferred embodiment, first contact portion 306 and connecting aperture 328 are substantially cylindrical. However other shapes may be used, as would be apparent to a person of ordinary skill in the art.

In the extended position shown in FIG. 3A, locking mechanism 312 is engaged with connection detent 316. The contact of locking mechanism 312 with connection detent 316 electrically connects radiating elements 208 and 212. However, in the retracted position shown in FIG. 3B, locking mechanism 312 is engaged with isolation detent 314. In this position, neither locking mechanism 312 nor first contact portion 306 has any contact with conductor portion 302 of connecting element 210. Therefore, when retracted, first radiating element 208 and second radiating element 212 are electrically isolated.

Whip portion 326 electrically connects contact portions 306 and 308. In a preferred embodiment, whip portion 326 is covered with an insulating dielectric material such as plastic. However, in alternate embodiments, whip portion 326 is not covered.

Communications interface 214 is attached to casing 102 and comprises an electrically conductive contact surface 310, and a mounting detent 320 formed on contact surface 310. Communications interface 214 is connected to RF communications circuitry 112 by wiring or other means known to persons skilled in the relevant arts. Communications interface 214 electrically connects with second contact portion 308 when composite radiator 206 is extended and electrically connects with conductor portion 302 of connecting element 210 when composite radiator 206 is retracted.

Contact surface 310 defines an interface aperture 350 that coaxially surrounds a portion of composite radiator 206. Interface aperture 350 has a first contact segment 352*a* and a second contact segment 352*b*. Contact segments 352*a* and 352*b* are substantially cylindrical. However, other shapes may be employed, as would be apparent to persons skilled in the relevant arts. When composite radiator 206 is retracted, connecting element 210 is disposed in first contact segment 352*a*. When composite radiator 206 is extended, second contact portion 308 of second radiating element 212 is disposed in second contact segment 352*b*.

First contact segment 352*a* enables contact between communications interface 214 and conductor portion 302 of connecting element 210 while enabling connecting element 210 to fit into interface aperture 350. First contact segment 352*a* has a diameter that enables connecting element 210 to be disposed in it. This diameter enables connecting element 210 to touch contact surface 310 and slide in and out of first contact segment 352*a* with friction. As described above, when composite radiator 206 is retracted, as shown in FIG. 3B, mounting mechanism 318 engages with mounting detent 320. Mounting detent 320 is a recess formed on contact surface 310 at first contact segment 352*a*. The contact of outer surface 342 and mounting mechanism 318 with contact surface 310 establishes an electrical connection between first radiating element 208 and communications interface 214.

Second contact segment 352*b* enables contact between communications interface 214 and second contact portion 308 of radiating element 212 while enabling second contact portion 308 to slide through communications interface 214. Second contact segment 352*b* has a diameter that enables second contact portion 308 and whip portion 326 to be disposed in it. This diameter enables second contact portion 308 to slide through second contact segment 352*b* with friction between contact surface 310 and second contact portion 308. Therefore, when composite radiator 206 is extended, as shown in FIG. 3A, the contact of second contact portion 308 with contact surface 310 establishes an electrical connection between radiating element 212 and communications interface 214. However, this diameter enables whip portion 326 to be disposed in second contact segment 352*b* without touching contact surface 310. Thus, when composite radiator 206 is retracted, as shown in FIG. 3B, the lack of contact between whip portion 326 and second contact segment 352*b* electrically isolates radiating element 212 and communications interface 214.

As stated above, FIG. 3A illustrates composite radiator 206 in an extended position. In this position, mounting mechanism 318 of connecting element 210 is disengaged from mounting detent 320. Locking mechanism 312 is engaged with connection detent 316. Therefore, radiating elements 208 and 212 are electrically connected. Also in this extended position, second contact portion 308 of radiating element 212 is in contact with contact surface 310. Thus, RF communications circuitry 112 transmits and/or receives RF signals through radiating elements 208 and 212 configured as a top loaded antenna.

Composite radiator 206 transitions from the extended position illustrated in FIG. 3A to the retracted position illustrated in FIG. 3B upon the application of a retracting force applied by a user to radiating element 208. As composite radiator 206 retracts, second end 324 contacts a stop mechanism 354 formed on casing 102. At this point, locking mechanism 312 disengages from connection detent 316 and engages with isolation detent 314 upon the application of the retracting force against stop mechanism 354.

While locking mechanism 312 engages with isolation detent 314, mounting mechanism 318 engages with mounting detent 320. This engagement places composite radiator 206 in the retracted position illustrated in FIG. 3B. In this position, radiating elements 208 and 212 are disconnected. In addition, radiating element 212 does not contact communications interface 214. Therefore, in this retracted position, RF communications circuitry 112 transmits and/or receives RF signals only through radiating element 208. Moreover, since second radiating element 212 is disconnected from RF communications circuitry 112 in this position, self-jamming problems are mitigated.

Composite radiator 206 transitions from the retracted position illustrated in FIG. 3B to the extended position illustrated in FIG. 3A upon the application of an extending force applied by a user to radiating element 208. As an extending force is applied to composite radiator 206, mounting mechanism 318 disengages from mounting detent 320. This disengagement allows composite radiator 206 to extend from casing 102. Composite radiator 206 extends from casing 102 until second end 324 abuts communications interface 214. Second end 324 of second radiating element 212 is wider than the diameter of second contact segment 352*b*. Therefore, when second end 324 abuts communications interface 214, the extension of second radiating element is stopped. At this point, the extending force causes locking mechanism 312 to disengage from isolation detent 314 and engage with connection detent 316. This engagement places composite radiator 206 in the extended position illustrated in FIG. 3A.

Figure 4A:
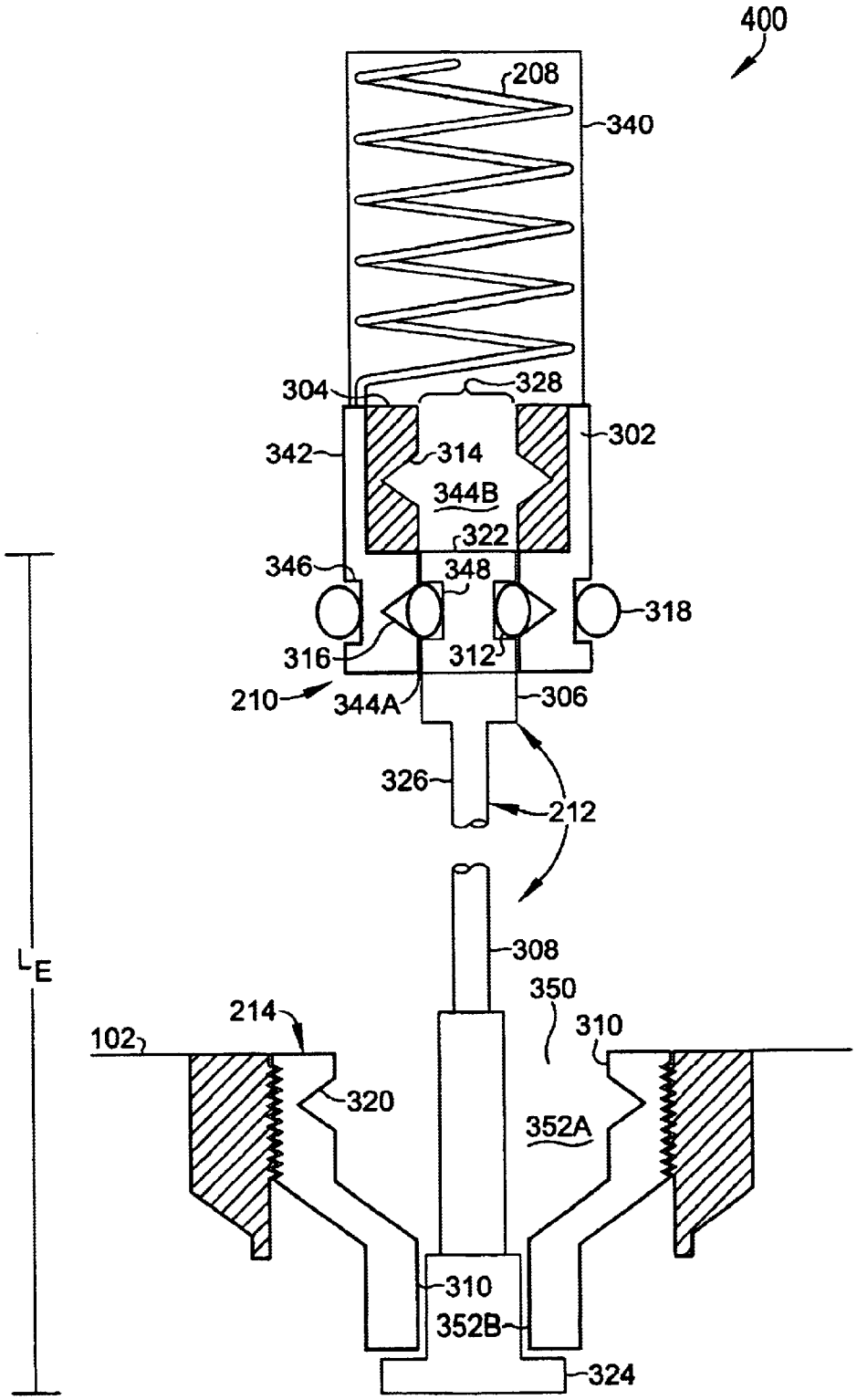
FIG. 4A is a cross-sectional view of a second implementation of a selectively coupled two-piece antenna in an extended state.
Figure 4B:
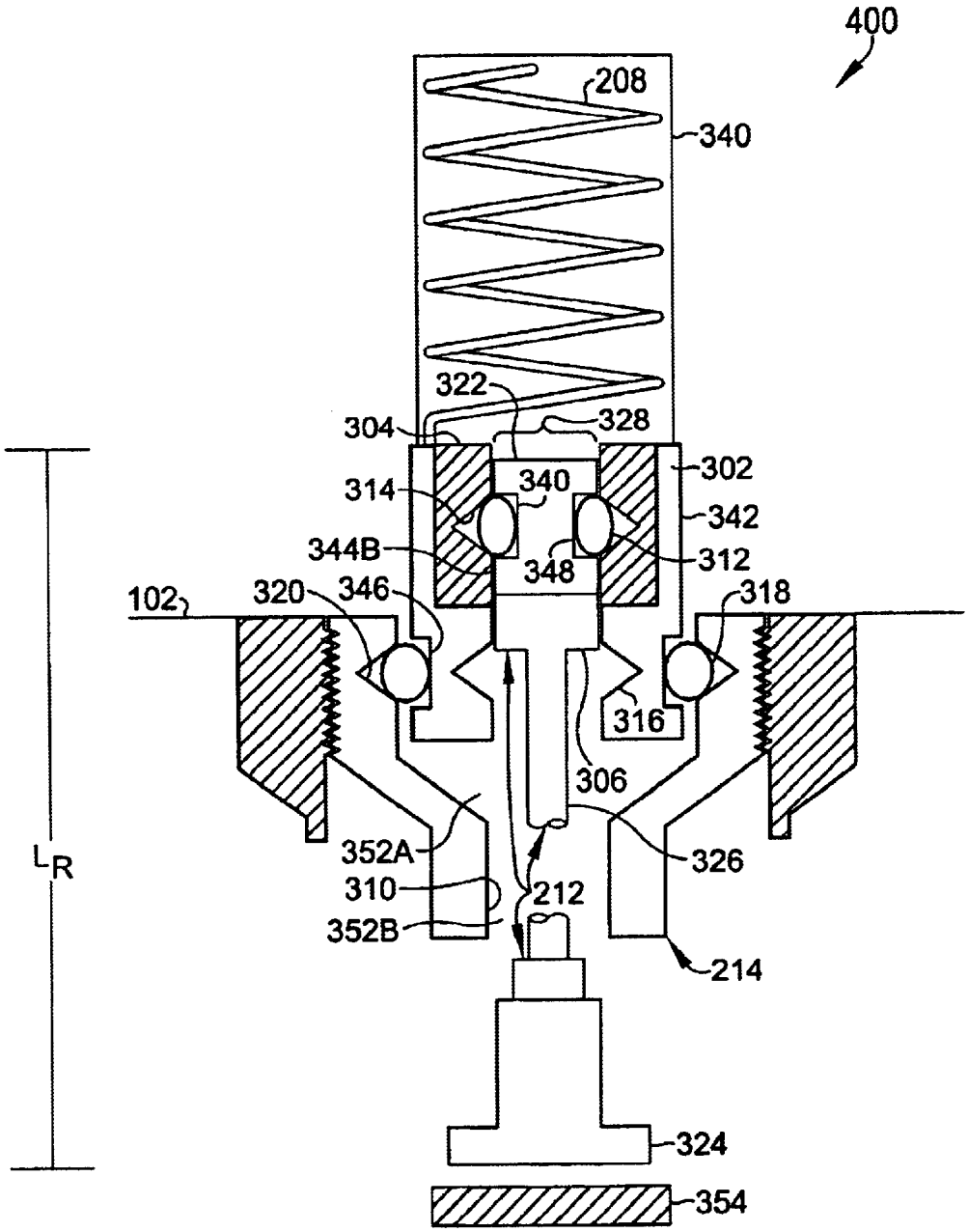
FIG. 4B is a cross-sectional view of a second implementation of a selectively coupled two-piece antenna in a retracted state.

FIGS. 4A and 4B are cross-sectional views of a second implementation 400 of antenna 200. FIG. 4A shows antenna 200 in an extended position. FIG. 4B shows antenna 200 in a retracted position. Like implementation 300 described above with reference to FIGS. 3A and 3B, implementation 400 of antenna 200 comprises composite radiator 206 and communications interface 214. Composite radiator 206 comprises first radiating element 208, connecting element 210, and second radiating element 212. However, in implementation 400, second radiating element 212 includes a second contact portion 308' that is telescoping.

When antenna 200 is in an extended position, telescoping second contact portion 308' is extended. Thus, second radiating element 212 has an extended length, $L_E$. Advantageously, $L_E$ is approximately a half-wavelength ($\lambda/2$). However, other electrical lengths can be used, as would be apparent to persons skilled in the relevant art(s).

When antenna 200 is in a retracted position, telescoping second contact portion 308' is retracted. Thus, second contact portion 308' has a retracted length, $L_R$ that is shorter than extended length, $L_E$. Advantageously, $L_R$ is approximately a quarter-wavelength ($\lambda/4$). However, other electrical lengths can be used, as would be apparent to persons skilled in the relevant art(s).

Telescoping second contact portion 308' retracts upon the application of a retracting force applied by a user to radiating element 208. As composite radiator 206 retracts, second end 324 contacts stop mechanism 354 formed on casing 102. This contact causes a compression force to be imparted on second contact portion 308' to occur, thereby retracting second contact portion 308'.

Telescoping second contact portion 308' extends upon the application of a extending force applied by a user to radiating element 208. During extension of composite radiator 206, after second end 324 abuts communications interface 214, retracted second contact portion 308' extends as extension of composite radiator continues.

The shortening of second contact portion 308' when composite radiator 206 is retracted mitigates parasitic coupling between radiating element 208 and second radiating element 212. Other techniques can be used to shorten second radiating element 212 when composite radiator 212 is retracted, as would be apparent to persons skilled in the relevant art(s).

Figure 5:
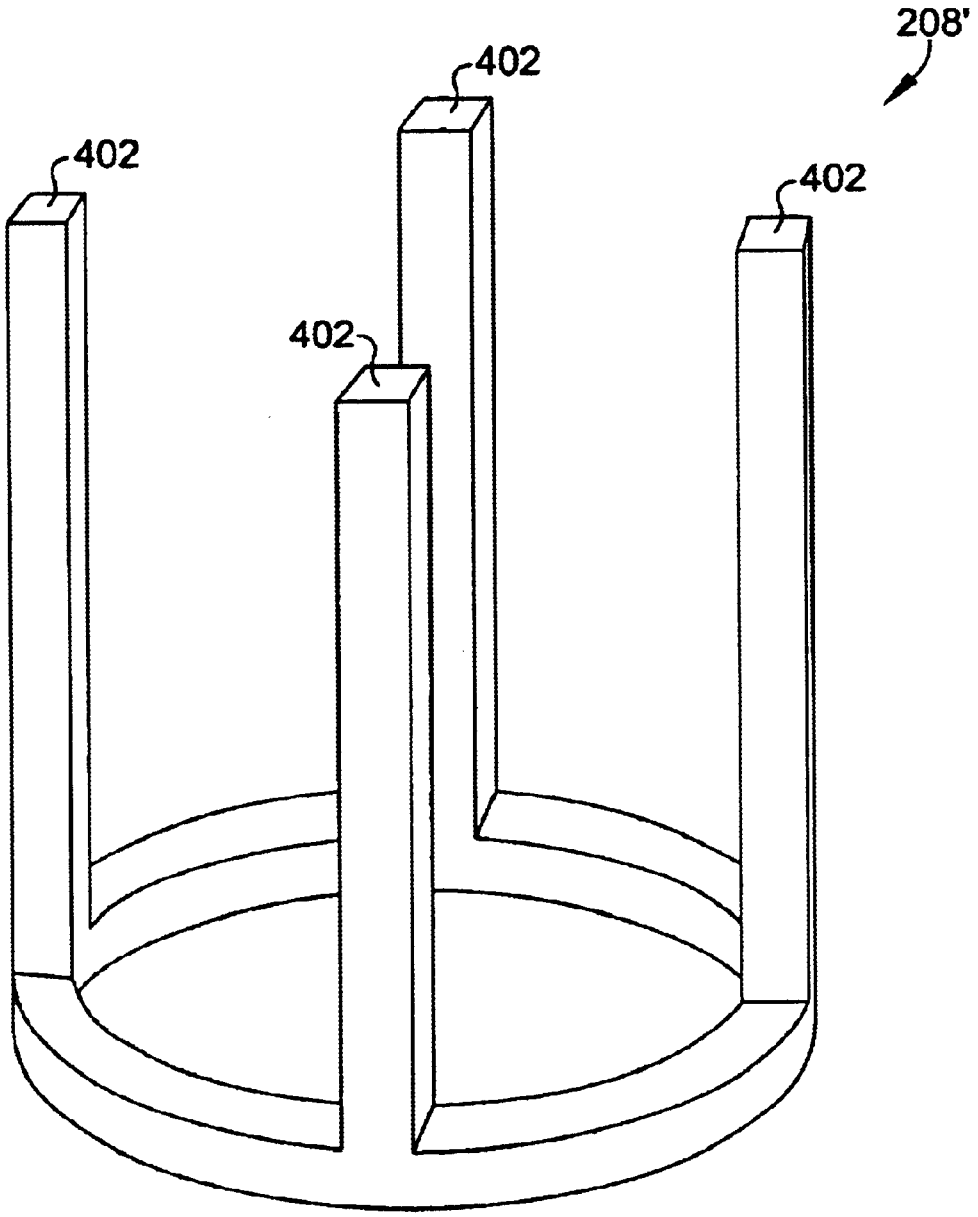
FIG. 5 is a view of a first radiating element.

As described above, radiating element 208 is preferably a helix. However, other antenna types may be employed. FIG. 5 is a view of an alternate radiating element 208'. As illustrated in FIG. 5 alternate radiating element 208' comprises a plurality of teeth 402. The number and length of these teeth may vary to form a top loaded antenna, as would be apparent to a person of ordinary skill in the art.

III. Conclusion

While various embodiments of the present invention have been described above, it should be understood that they have been presented by way of example only, and not limitation. For example, the present invention may be applied to any type of wireless communications device, as would be apparent to a person of ordinary skill in the art. Thus, the breadth and scope of the present invention should not be limited by any of the above-described exemplary embodiments, but should be defined only in accordance with the following claims and their equivalents.

What is claimed is:

1. A selectively coupled two-piece antenna for use in a mobile phone having a casing and radio frequency (RF) communications circuitry, the antenna comprising:

a composite radiator that is selectively extendable from and retractable into the casing, said composite radiator having a) a first radiating element, b) a connecting element comprising a conductor portion and an insulator portion, wherein said conductor portion is electrically connected to said first radiating element;

c) a second radiating element having first and second contact portions that are electrically connected, wherein said first contact portion contacts said conductor portion of said connecting element when said composite radiator is extended, and wherein said first contact portion contacts said insulator portion of said connecting element when said composite radiator is retracted; and a communications interface attached to the casing, wherein said communications interface is electrically coupled to said second contact portion when said composite radiator is extended and is electrically coupled to said conductor portion of said connected element when said composite radiator is retracted;

whereby said first and second radiating elements are electrically connected to the RF communications circuitry when said composite radiator is extended, and said second radiating element is electrically disconnected from the RF communications circuitry when said composite radiator is retracted;

wherein said second radiating element comprises a conductive locking mechanism attached to said first contact portion; and wherein said connecting element comprises:

an isolation detent formed on said insulator portion that engages with said locking mechanism when said composite radiator is retracted, thereby electrically isolating said first and second radiating elements, and a connection detent formed on said conductor portion that engages with said locking mechanism when said composite radiator is extended, thereby electrically connecting said first and second radiating elements.

2. The selectively coupled two-piece antenna according to claim 1, wherein said locking mechanism disengages from said connection detent and engages with said isolation detent upon the application of a retracting force against a stop mechanism formed on the casing.

3. The selectively coupled two-piece antenna according to claim 1, wherein said locking mechanism disengages from said isolation detent and engages with said connection detent upon the application of an extending force applied to said first radiating element.

4. A selectively coupled two-piece antenna for use in a mobile phone having a casing and radio frequency (RF) communications circuitry, the antenna comprising:

a composite radiator that is selectively extendable from and retractable into the casing, said composite radiator having a) a first radiating element, b) a connecting element comprising a conductor portion and an insulator portion, wherein said conductor portion is electrically connected to said first radiating element;

c) a second radiating element having first and second contact portions that are electrically connected, wherein said first contact portion contacts said conductor portion of said connecting element when said composite radiator is extended, and wherein said first contact portion contacts said insulator portion of said connecting element when said composite radiator is retracted; and a communications interface attached to the casing, wherein said communications interface is electrically coupled to said second contact portion when said composite radiator is extended and is electrically coupled to said conductor portion of said connecting element when said composite radiator is retracted;

whereby said first and second radiating elements are electrically connected to the RF communications circuitry when said composite radiator is extended, and said second radiating element is electrically disconnected from the RF communications circuitry when said composite radiator is retracted;

wherein said connecting element comprises a conductive mounting mechanism attached to said conductor portion; and wherein said communications interface comprises a mounting detent that engages with said mounting mechanism when said composite radiator is retracted.

5. The selectively coupled two-piece antenna according to claim 4, wherein said mounting mechanism disengages from said mounting detent upon the application of an extending force applied to said first radiating element.

* * * * *